US006581920B1

(12) United States Patent
Smith et al.

(10) Patent No.: US 6,581,920 B1
(45) Date of Patent: Jun. 24, 2003

(54) PORTABLE MULTI-PURPOSE WORKSTATION ASSEMBLY

(76) Inventors: Jeffrey W. Smith, 51 McDermott St., Milford, CT (US) 06460; Dwayne Hoffman, 51 McDermott St., Milford, CT (US) 06460

( * ) Notice: Subject to any disclaimer, the term of this patent is extended or adjusted under 35 U.S.C. 154(b) by 0 days.

(21) Appl. No.: 10/134,758

(22) Filed: Apr. 30, 2002

(51) Int. Cl.[7] ..... B25B 1/00
(52) U.S. Cl. ..... 269/17; 254/134
(58) Field of Search ..... 269/16, 17, 15, 269/47, 139; 254/133 R, 134

(56) References Cited

U.S. PATENT DOCUMENTS 4,533,127 A * 8/1985 Hawkins ..... 269/17
4,705,264 A * 11/1987 Hawkins et al. ..... 269/17
5,338,015 A * 8/1994 Liegel et al. ..... 269/71
5,603,491 A * 2/1997 Murrell ..... 269/17
5,851,007 A * 12/1998 Swartzlander et al. ..... 269/17

* cited by examiner

*Primary Examiner*—Lee Wilson

(57) ABSTRACT

A portable multi-purpose workstation assembly for allowing users to mount two engines side-by-side and to easily transfer parts from one engine to the other engine. The portable multi-purpose workstation assembly includes a base assembly including a plurality of elongate base members, and also including base connecting members interconnecting and supporting the elongate base members, and further including wheel assemblies upon which the elongate base members and the base connecting members are supported; and also includes a support assembly being adjustably mounted upon the base assembly, and including sleeve members being disposed about one of the elongate base members, and also including post members being attached to the sleeve members, and further including bracket assemblies being mounted upon the post members.

10 Claims, 3 Drawing Sheets

PORTABLE MULTI-PURPOSE WORKSTATION ASSEMBLY

BACKGROUND OF THE INVENTION

1. Field of the Invention

The present invention relates to multi-purpose workstations and more particularly pertains to a new portable multi-purpose workstation assembly for allowing users to mount two engines side-by-side and to easily transfer parts from one engine to the other engine.

2. Description of the Prior Art

The use of multi-purpose workstations is known in the prior art. More specifically, multi-purpose workstations heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,765,667; U.S. Pat. No. 3,675,914; U.S. Pat. No. 5,667,207; U.S. Pat. No. 4,239,196; U.S. Pat. No. 4,533,127; and U.S. Pat. No. Des. 324,599.

While these devices fulfill their respective, particular objectives and requirements, the aforementioned patents do not disclose a new portable multi-purpose workstation assembly. The prior art describes inventions having base members and support members to support but one engine.

SUMMARY OF THE INVENTION

The general purpose of the present invention, which will be described subsequently in greater detail, is to provide a new portable multi-purpose workstation assembly which has many of the advantages of the multi-purpose workstations mentioned heretofore and many novel features that result in a new portable multi-purpose workstation assembly which is not anticipated, rendered obvious, suggested, or even implied by any of the prior art multi-purpose workstations, either alone or in any combination thereof. The present invention includes a base assembly including a plurality of elongate base members, and also including base connecting members interconnecting and supporting the elongate base members, and further including wheel assemblies upon which the elongate base members and the base connecting members are supported; and also includes a support assembly being adjustably mounted upon the base assembly, and including sleeve members being disposed about one of the elongate base members, and also including post members being attached to the sleeve members, and further including bracket assemblies being mounted upon the post members. None of the prior art includes multiple post members nor the bracket assemblies of the present invention which allows the user to work on multiple objects at the same time.

There has thus been outlined, rather broadly, the more important features of the portable multi-purpose workstation assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable multi-purpose workstation assembly which has many of the advantages of the multi-purpose workstations mentioned heretofore and many novel features that result in a new portable multi-purpose workstation assembly which is not anticipated, rendered obvious, suggested, or even implied by any of the prior art multi-purpose workstations, either alone or in any combination thereof.

Still another object of the present invention is to provide a new portable multi-purpose workstation assembly for allowing users to mount two engines side-by-side and to easily transfer parts from one engine to the other engine.

Still yet another object of the present invention is to provide a new portable multi-purpose workstation assembly that is easy and convenient to set up and use.

Even still another object of the present invention is to provide a new portable multi-purpose workstation assembly that improves productivity by reducing the amount time used to work on engines.

These together with other objects of the invention, along with the various features of novelty which characterize the invention, are pointed out with particularity in the claims annexed to-and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
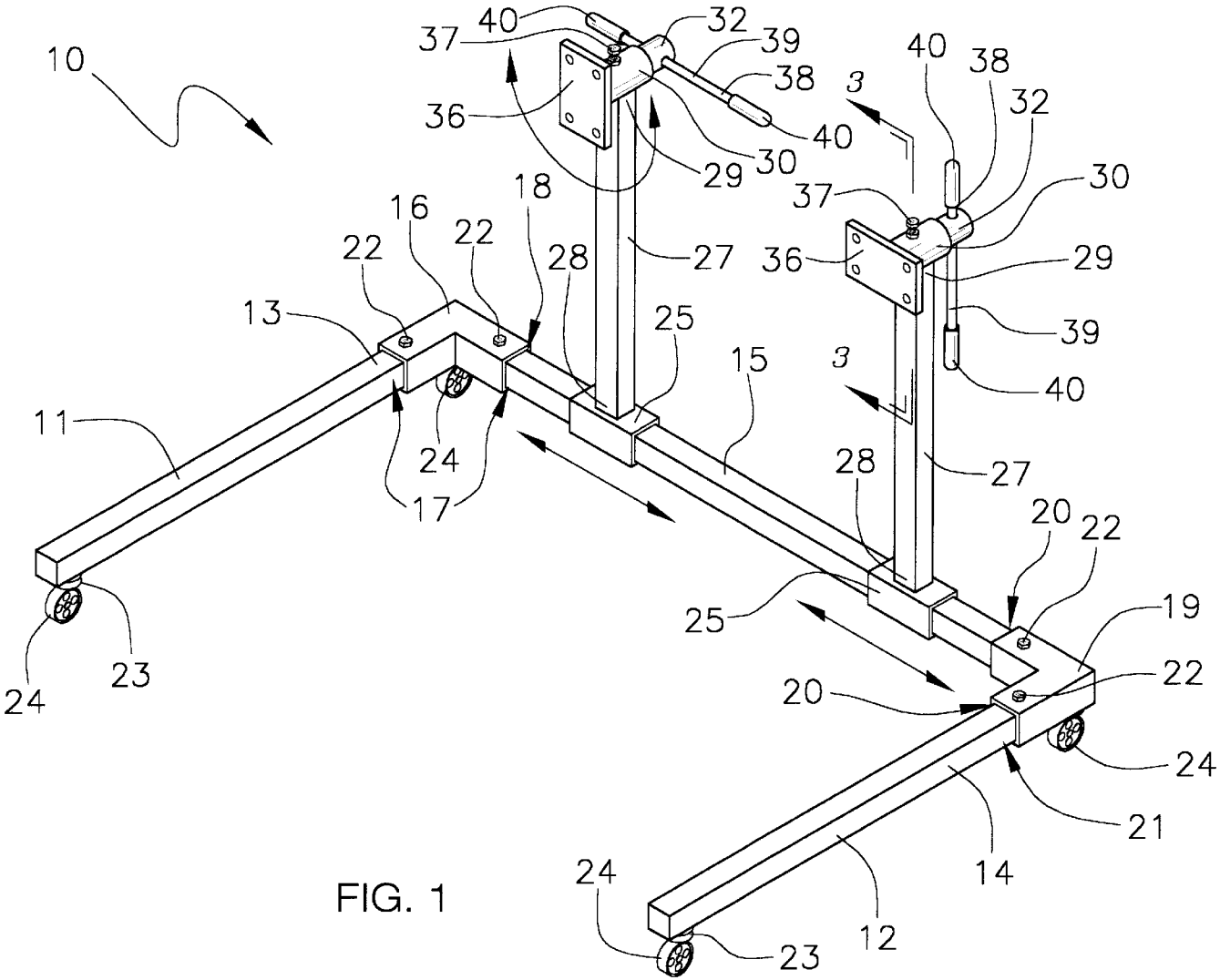
FIG. 1 is a perspective view of a new portable multi-purpose workstation assembly according to the present invention.
Figure 2:
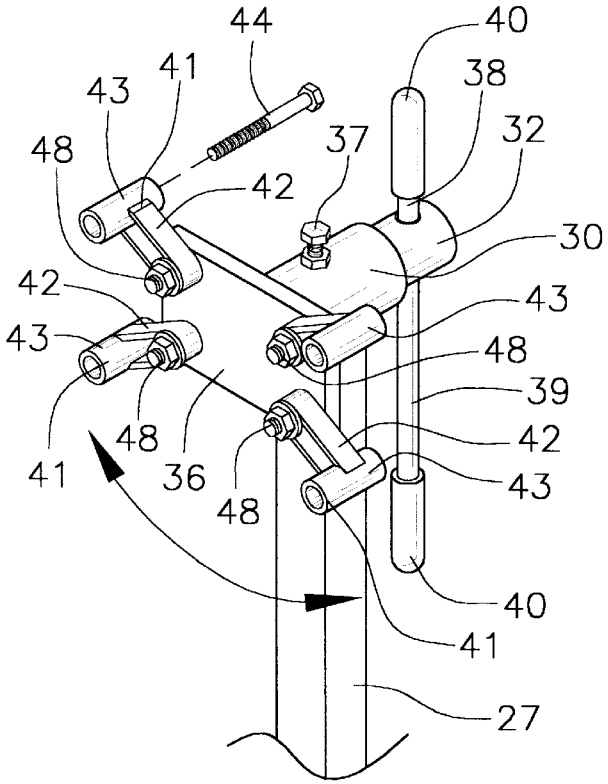
FIG. 2 is a partial perspective view of the present invention.
Figure 3:
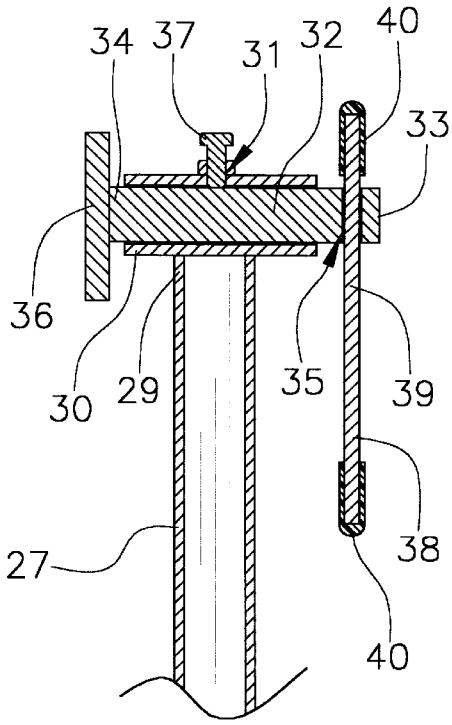
FIG. 3 is a partial cross-sectional view of the present invention.
Figure 4:
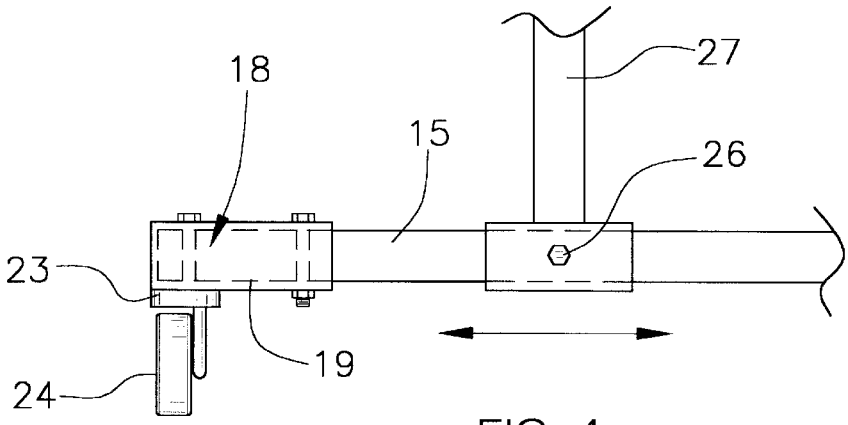
FIG. 4 is a partial rear elevational view of the base member of the present invention.
Figure 5:
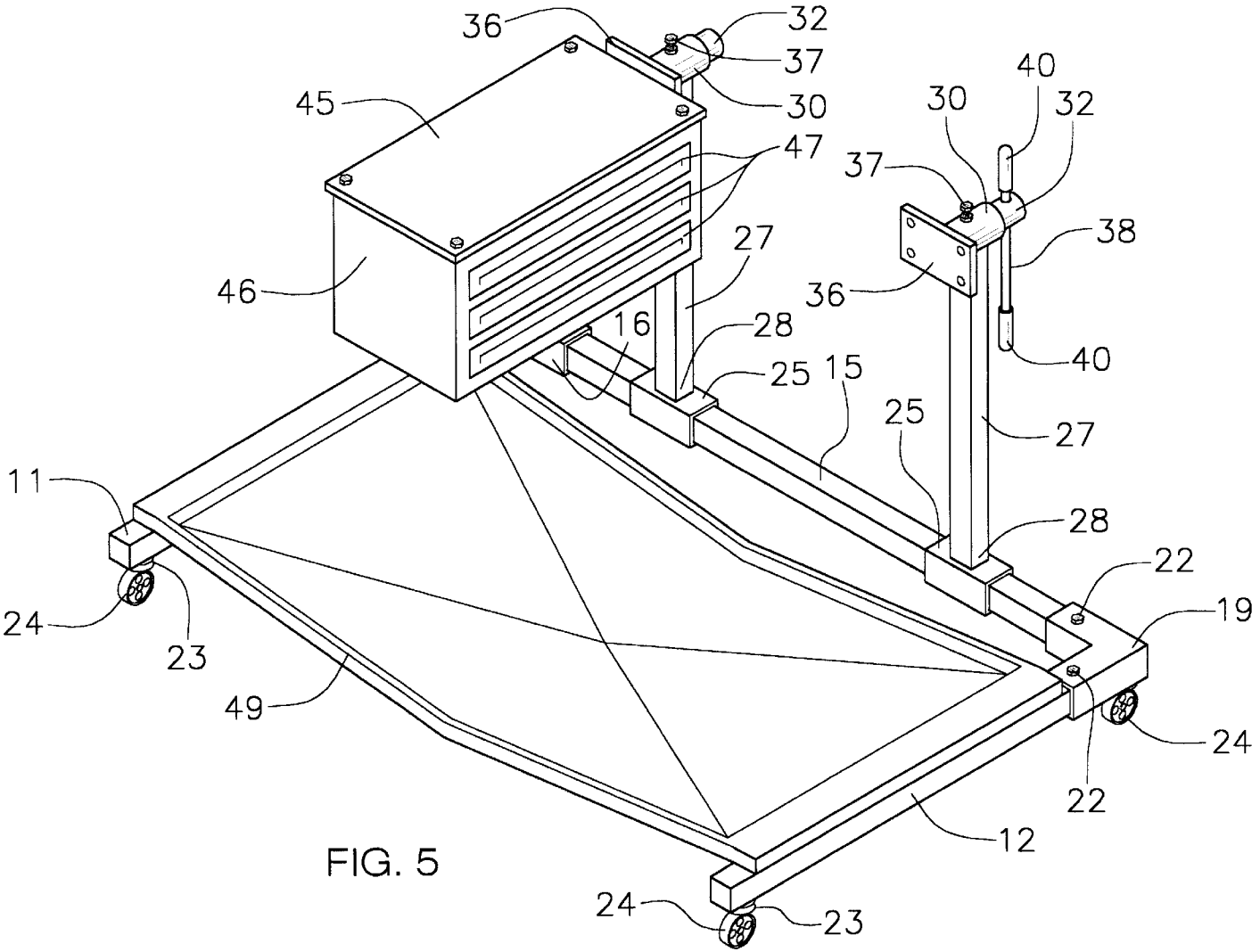
FIG. 5 is a perspective view of the present invention shown in use.

With reference now to the drawings, and in particular to FIGS. 1 through 5 thereof, a new portable multi-purpose workstation assembly embodying the principles and concepts of the present invention and generally designated by the reference numeral will be described.

As best illustrated in FIGS. 1 through 5, the portable multi-purpose workstation assembly 10 generally comprises a base assembly including a plurality of elongate base members 11,12,15, and also including base connecting members 16,19 interconnecting and supporting the elongate base members 11,12,15, and further including wheel assemblies 23,24 upon which the elongate base members 11,12,15 and the base connecting members 16,19 are conventionally supported. The elongate base members 11,12,15 include a pair of elongate side members 11,12 having first ends 13,14 securely and detachably attached to the base connecting members 16,19, and also includes an elongate cross member 15 having ends which are securely and detachably attached to the base connecting members 16,19. The base connecting members 16,19 are angled tubular members having open ends 17,20 and bores 18,21 extending therethrough with the first end 13,14 of a respective elongate side member 11,12 being extended in the bore 18,21 through one of the open ends 17,20 of a respective base connecting member 16,19 and being fastened therein with a fastening member 22 removably extending though the base connecting member 16,19 and the elongate side member 11,12. The ends of the elongate cross member 15 are extended in respective the open ends 17,20 of the base connecting members 16,19.and being fastened therein with fastening members 22 removably extending through the base connecting members 16,19 and the elongate cross member 15. The wheel assemblies 23,24 include bracket members 23 being securely and conventionally attached to the elongate side members 11,12 and to the base connecting members 16,19, and also include wheel members 24 being rotatably and conventionally mounted to the bracket members 23.

A support assembly is adjustably mounted upon the base assembly, and includes sleeve members 25 being disposed about one of the elongate base members 15, and also includes post members 27 being conventionally attached to the sleeve members 25, and further includes bracket assemblies being mounted upon the post members 27. The sleeve members 25 are slidably and fastenably attached with fastening members 26 about the elongate cross member 15. The post members 27 have first ends 28 which are conventionally attached to and extended upwardly from the sleeve members 25. The bracket assemblies include sleeves 30 being conventionally attached and welded to second ends 29 of the post members 27 with longitudinal axes of the sleeves 30 being disposed generally perpendicular to longitudinal axes of the post members 27, and also include elongate plate support members 32 being. fastenably and movably disposed in the sleeves 30 and having first and second ends 33,34, and further includes plate members 36 being securely and conventionally attached to the second ends 34 of the elongate plate support members 36, and also includes handle members 38 being slidably connected to the elongate plate support members 32. The sleeves 30 have:holes 31 extending through walls thereof with fasteners 37 being threaded in the holes 31 and being engagable to the elongate plate support members 32. The elongate plate support members 32 have bores 35 extending laterally therethrough near the first ends 33 thereof. The handle members 38 slidably extend through the bores 35 of the elongate plate support members 32, and include elongate shafts 39 and endcap members 40 engagably fitted about ends of the elongate shafts 39 to prevent the elongate shafts 39 from unintentionally sliding out of the bores 35 of the elongate plate support members 32. The support assembly further includes engine mounting brackets 41 being fastened to the plate members 36 with fastener members 48, and also includes mounting bolts 44 being extendable through the engine mounting brackets 41 for fastening to engines. Each of the engine mounting brackets 41 includes an oblong loop member 42 and a tubular member 43 being conventionally attached to the oblong loop member 42 and through which a respective the mounting bolt 44 is extendable. The support assembly also includes a workbench member 45 being conventionally attached to one of the plate members 36, and also includes a toolbox member 46,47 being fastened to and suspended from the workbench member 45 and also having a cabinet 46 with drawers 47 being movably disposed in and from the cabinet 46. The support assembly further includes a pan 49 being removably supported upon the elongate base members 11,12,15 for collecting oil dripping from engines fastened to the plate members 36.

In use, the user bolts the engines to the engine mounting bracket 41 using the mounting bolts 44, and can work on both engines a the same time since both engines are closely spaced apart. The user can take parts from one engine and easily attach them to the other engine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable multi-purpose workstation assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable multi-purpose workstation assembly comprising:

a base assembly including a plurality of elongate base members, and also including base connecting members interconnecting and supporting said elongate base members, and further including wheel assemblies upon which said elongate base members and said base connecting members are supported, said elongate base members including a pair of elongate side members having first ends securely and detachably attached to said base connecting members, and also including an elongate cross member having ends which are securely and detachably attached to said base connecting members, said base connecting members being angled tubular members having open ends and bores extending therethrough, said first end of a respective said elongate side member being extended in said bore through one of said open ends of a respective said base connecting member and being fastened therein with a fastening member removably extending though said base connecting member and said elongate side member, said ends of said elongate cross member being extended in respective said open ends of said base connecting members and being fastened therein with fastening members removably extending through said base connecting members and said elongate cross member, said wheel assemblies including bracket members being securely attached to said elongate side members and to said base connecting members, and also including wheel members being rotatably mounted to said bracket members; and a support assembly being adjustably mounted upon said base assembly, and including sleeve members being disposed about one of said elongate base members, and also including post members being attached to said sleeve members, and further including bracket assemblies being mounted upon said post members, said sleeve members being slidably and fastenably attached with fastening members about said elongate cross member.

2. The portable multi-purpose workstation assembly as described in claim 1, wherein said post members have first ends which are attached to and extended, upwardly from said sleeve members.

3. The portable multi-purpose workstation assembly as described in claim 2, wherein said bracket assemblies include sleeves being attached to second ends of said post members with longitudinal axes of said sleeves being disposed generally perpendicular to longitudinal axes of said post members, and also include elongate plate support members being fastenably and movably disposed in said sleeves and having first and second ends, and further includes plate members being securely attached to said second ends of said elongate plate support members, and also includes handle members being slidably connected to said elongate plate support members.

4. The portable multi-purpose workstation assembly as described in claim 3, wherein said sleeves have holes extending through walls thereof with fasteners being threaded in said holes and being engagable to said elongate plate support members.

5. The portable multi-purpose workstation assembly as described in claim 4, wherein said elongate plate support members have bores extending laterally therethrough near said first ends thereof.

6. The portable multi-purpose workstation assembly as described in claim 5, wherein said handle members slidably extend through said bores of said elongate plate support members, and include elongate shafts and endcap members engagably fitted about ends of said elongate shafts to prevent said elongate shafts from unintentionally sliding out of said bores of said elongate plate support members.

7. The portable multi-purpose workstation assembly as described in claim 6, wherein said support assembly further includes engine mounting brackets being fastened to said plate members with fastener members, and also includes mounting bolts being extendable through said engine mounting brackets for fastening to engines.

8. The portable multi-purpose workstation assembly as described in claim 7, wherein each of said engine mounting brackets includes an oblong loop member and a tubular member being attached to said oblong loop member and through which a respective said mounting bolt is extendable.

9. The portable multi-purpose workstation assembly as described in claim 8, wherein said support assembly also includes a workbench member being attached to one of said plate members, and also includes a toolbox member being fastened to and suspended from said workbench member and also having a cabinet with drawers being movably disposed in and from said cabinet.

10. portable multi-purpose workstation assembly as described in claim 9, wherein said support assembly further includes a pan being removably supported upon said elongate base members for collecting oil dripping from engines fastened to said plate members.

* * * * *